United States Patent [19]

Arenson et al.

[11] Patent Number: 4,886,270

[45] Date of Patent: Dec. 12, 1989

[54] WISHBONE SHAPED AMUSEMENT DEVICE

[75] Inventors: Herbert Arenson, Shawnee Mission, Kans.; Ann K. Jordan, Monument, Colo.

[73] Assignee: Wish-Bon, Inc., Leawood, Kans.

[21] Appl. No.: 307,881

[22] Filed: Feb. 7, 1989

[51] Int. Cl.[4] ..... A63F 9/00

[52] U.S. Cl. ..... 273/139; 426/104

[58] Field of Search ..... 273/138 R, 139; 426/104

[56] References Cited

U.S. PATENT DOCUMENTS

| | | | |
|---|---|---|---|
| 260,055 | 6/1882 | Schwarzschild . | |
| 294,575 | 3/1884 | Britton . | |
| 943,945 | 12/1909 | Liebich . | |
| 1,080,971 | 12/1913 | Isaacs | 426/104 |
| 1,254,115 | 6/1918 | Brand . | |
| 1,623,926 | 4/1927 | Kohler . | |
| 2,030,126 | 2/1936 | Vogt . | |
| 2,036,706 | 4/1936 | Lau . | |
| 2,246,770 | 6/1941 | Wessel . | |
| 2,315,164 | 3/1943 | Schiller | 273/146 X |
| 2,617,324 | 11/1952 | Brody . | |
| 2,766,123 | 10/1956 | Meubayed . | |
| 2,867,536 | 1/1959 | Mead et al. . | |
| 2,901,357 | 8/1959 | Epstein . | |
| 2,975,925 | 3/1961 | Chambers . | |
| 3,062,662 | 11/1962 | McDonald . | |
| 3,545,980 | 12/1970 | Stanger . | |
| 3,707,289 | 12/1972 | Wicks | 273/139 |
| 3,770,278 | 11/1973 | Mueller | 273/153 R |
| 3,824,322 | 7/1974 | Fiorella . | |
| 4,229,482 | 10/1980 | Kreske, Jr. . | |

FOREIGN PATENT DOCUMENTS

| | | | |
|---|---|---|---|
| 2055646 | 5/1972 | Fed. Rep. of Germany . | |
| 1361328 | 4/1964 | France | 273/138 R |
| 198282 | 5/1923 | United Kingdom . | |

*Primary Examiner*—Anton O. Oechsle

*Attorney, Agent, or Firm*—Wm. Bruce Day

[57] ABSTRACT

A wishbone shaped amusement device includes a body having spaced, hollow, divergent legs joined at a head portion. An attractant feature is placed within the body and is distinct therefrom and is preferably emplaced within at least one of the legs. The attractant feature comprises a prize, including a message, coupon, fragrance vial, device or other means of endearment for the recipient. The leg is separable to reveal the prize therein.

6 Claims, 2 Drawing Sheets

WISHBONE SHAPED AMUSEMENT DEVICE

FIELD OF THE INVENTION

This invention relates to amusement devices, and in particular to a comestible amusement device having a separable portion to reveal an attractant feature therein.

BACKGROUND OF THE INVENTION

The wishbone of poultry has long been recognized as a symbol of good luck and a ritual is normally played at the dinner table in which two persons normally grasp the ends of the legs of a wishbone and pull away from the central head portion. The recipient of the longer leg portion, the leg and head combined, is considered to be "lucky" and his or her wish is popularly said to come true. Although clearly, this amusement ritual has no scientific basis, it is nevertheless a popular game. The present invention employs the popular concept of the wishbone but provides means enabling the recipient to obtain a prize, not just make a wish. In its preferred embodiment, the device comprises a comestible; however, alternative, non-comestible forms, even including those made of precious or semi-precious materials may be utilized.

OBJECTS OF THE INVENTION

The principal objects of the present invention are: to provide a wishbone shaped body having spaced diverging legs and formed of an edible material; to provide an attractant feature within said body consisting of a different substance than the body, and placed within at least one of the legs, and comprising a prize for the consumer of the body; to provide a wishbone shaped body with frangible separation means connecting the legs to a head portion of the body whereupon separation of at least one leg from the head portion, the attractant material is exposed; to provide such an amusement device in which the body may be of a precious or semi-precious material; to provide such an amusement device in which the body may be of a pastry material; to provide such an amusement device in which the body may be of a candy material; to provide such an amusement device which may be reused, such as at special occasions; to provide such an amusement device which is suitable as a gift; and to provide such an amusement device which is relatively inexpensive and particularly well adapted for the intended purpose.

Other objects and advantages of this invention will become apparent from the following description taken in connection with the accompanying drawings wherein are set forth by way of illustration and example, certain embodiments of this invention.

DESCRIPTION OF THE PREFERRED AND ALTERNATE EMBODIMENTS

Figure 1:
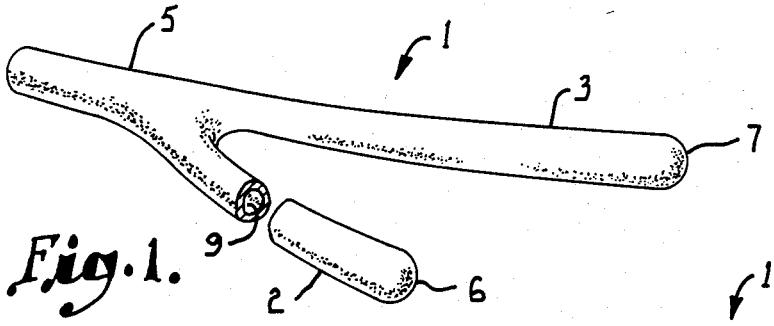
FIG. 1 is a perspective view of a wishbone shaped amusement device and showing an attractant material placed within one of the legs.
Figure 2:
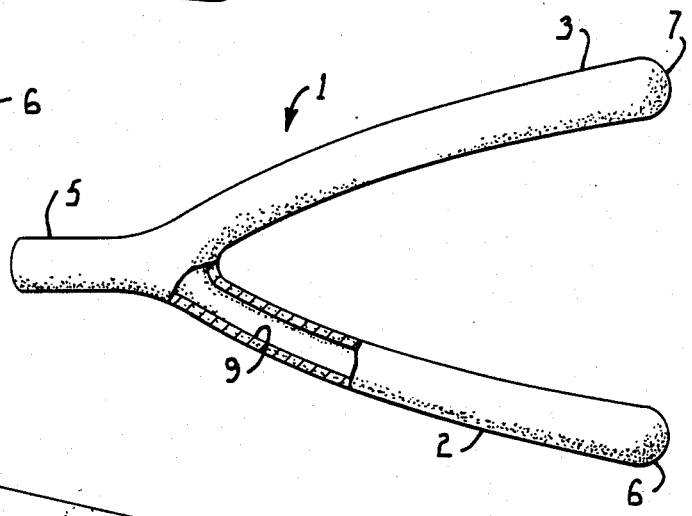
FIG. 2 is a plan view thereof.

As required, detailed embodiments of the present invention are disclosed herein; however, it is to be understood that the disclosed embodiments are merely exemplary of the invention which may be embodied in various forms, therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

The reference numeral 1, generally indicates a wishbone shaped body formed of spaced, left and right diverging legs 2 and 3 joined at a head portion 5. In the illustrated example, the legs 2 and 3 are substantially equal in length, however, it is not necessary that they be equal. Overall, the legs 2 and 3 join to the head portion 5 and form a Y-shaped or wishbone shaped body. The legs 2 and 3 have respective closed ends 6 and 7 which may be formed as set forth below. At least one of the legs 2 and 3 is formed either entirely with a hollow interior or at least a portion thereof has a hollow interior 9. The hollow interior 9 receives a prize 10 for a consumer of the body. It is foreseen that there be many different types of prizes, not necessarily of tubular shape, which would serve as a reward and an inducement for the purchaser of the product. The prize may include a rolled up paper message, a comestible such as a candy, a fragrance vial, or other means of endearment for the recipient. Clearly, when the body 1 is formed of a comestible material, the prize should also be comestible, or at least non-injurious to the purchaser of the product, such as a rolled up paper message. When the body 1 is formed of precious, semi-precious or non-comestible material, then the prize may be accordingly formed of a non-comestible material, such as the fragrance vial. In the illustrated example, FIG. 3, the prize 10 is a rolled up paper message which may pose a greeting, riddle, joke or other writing.

Figure 3:
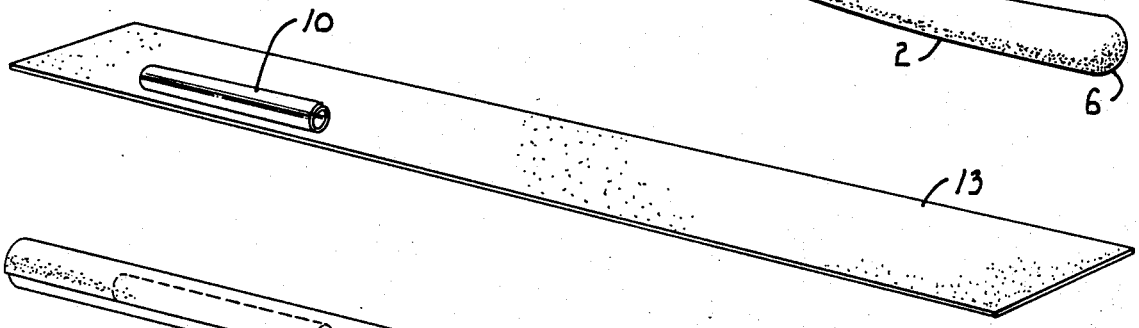
FIG. 3 shows a manner of making the amusement device from rolled dough.
Figure 4:
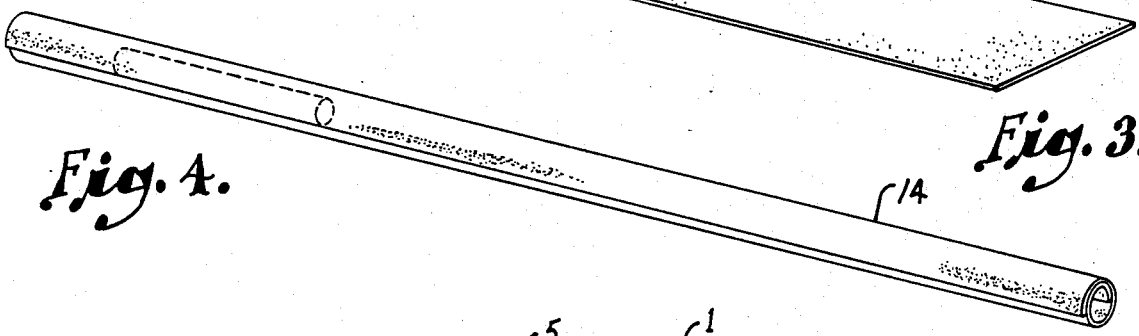
FIG. 4 shows a manner of forming the wishbone shaped article from the length of rolled dough shown in FIG. 3

One example of how the wishbone shaped body is constructed is shown in accordance with FIGS. 3, 4, 5 and 6. Therein, the body is formed of an elongate, flat sheet of dough 13 which is rolled into a hollow, cylindrical form 14, FIG. 4, pinched off at the ends 6 and 7, arched to form the left and right legs 2 and 3, and pinched at the mid-portion to form the head portion 5, FIG. 5. As shown in FIG. 3, the prize 10 is rolled up with the dough.

Figure 5:
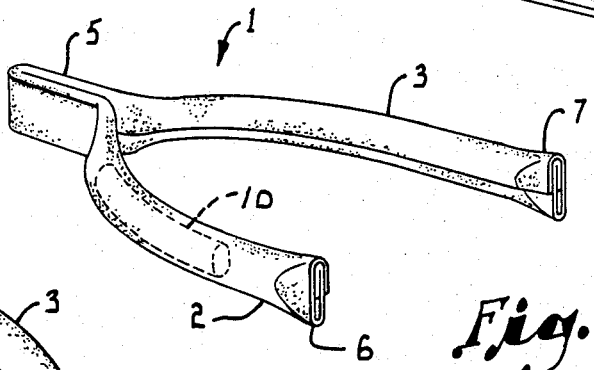
FIG. 5 is a perspective view of a wishbone shaped amusement device made from rolled dough.
Figure 6:
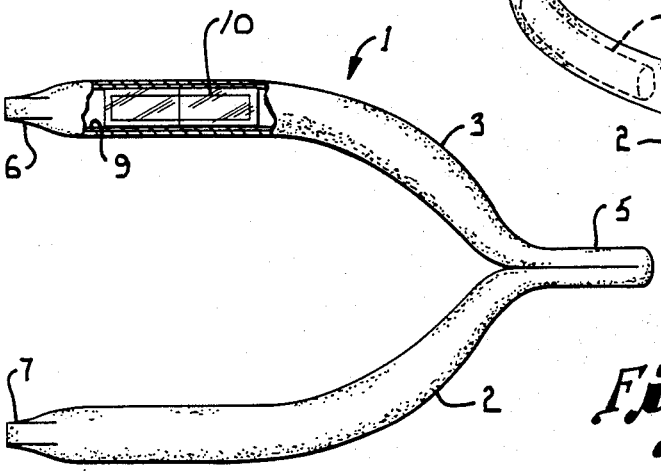
FIG. 6 is a plan view of a wishbone shaped amusement device made from rolled dough.

Alternatively, a hollow leg can be formed from extruded dough, chocolate, or other candy substance and the prize 10 placed in a portion thereof. The length of hollow extruded material is appropriately formed into the wishbone shaped body 1, as shown in FIG. 5.

In the case of a comestible, upon frangible separation of a portion of the selected left or right leg 2 or 3, the prize 10 may or may not be exposed, depending if the recipient has selected the correct leg. As a comestible, the leg will be frangible and capable of being broken into upon application of light force to expose the prize 10 therein.

Figure 7:
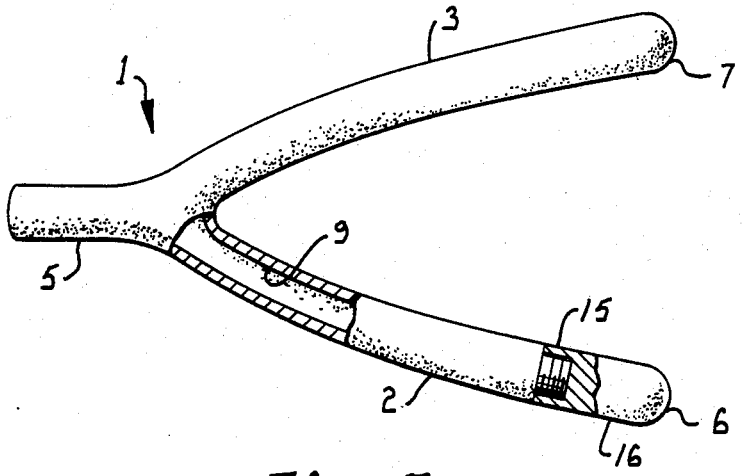
FIG. 7 is an alternate embodiment in which the wishbone shaped body may be formed of a precious or semi-precious material and has a separation means in one leg.

An alternative embodiment is shown in connection with FIG. 7, wherein the body 1 may be formed of a non-comestible or in-edible material, such as a precious or semi-precious material or even an extruded plastic. The extrusion process would appear to be suitable for the manufacture of the embodiment of FIG. 7, although other processes which provide a hollow interior 9 may be appropriate. In the example of FIG. 7, a separation means 15 is used with the left leg 2 and in the illustrated example, the separation means comprises an inner and outer threaded section so that the closed end 6 forms a radial, disconnectible cap 16 over the hollow interior of the remainder of the leg 2. Thus, the embodiment shown in FIG. 7 may be used as a gift to a particular friend, concealing for a short time the true nature of the contents therein and leading to great surprise.

It is foreseen that many different types of construction processes may be used, many types of prizes 10 placed within the wishbone body and that the wishbone body itself may be formed of a number of different types of substances.

It is to be understood that while one form of this invention has been illustrated and described, it is not to be limited to the specific form or arrangement of parts herein described and shown, except insofar as such limitations are included in the following claims.

What is claimed and desired to be secured by Letters Patent is as follows:

1. A comestible comprising:

a. a wishbone shaped body comprising of spaced, diverging legs joined at a head portion, said body being formed of an edible material;

b. an attractant material of a different substance than said body, emplaced within at least one of said legs, and comprising a prize for a consumer of said body; and c. frangible separation means connecting said legs to said head portion whereby, upon separation of at least one leg from said head portion, said attractant material is exposed.

2. A comestible comprising:

a. a wishbone shaped body comprised of spaced, diverging legs joined at a head portion, said legs being substantially tubular and having a hollow interior, said body formed of an edible material;

b. an attractant material of a different material than said body and emplaced within at least one of said legs, and comprising a prize for a consumer of said body; and c. frangible separation means connecting said legs to said head portion whereby upon separation of at least one leg from said head portion, said attractant material is exposed.

3. A comestible comprising:

a. a wishbone shaped pastry body having spaced, diverging legs joined at a head portion;

b. an attractant material of a different substance than said pastry body and emplaced within at least one of said legs, and comprising a prize for a consumer of said pastry body; and c. frangible separation means connecting said legs to said head portion whereby, upon separation of at least one leg from said head portion, said attractant material is exposed.

4. A comestible comprising:

a. a wishbone shaped body of an edible substance having spaced, diverging legs joined at a head portion;

b. an attractant feature within said body and distinct thereon, emplaced within at least one of said legs, and comprising a prize for a consumer of said body; and c. frangible separation means connecting at least said one leg to said head portion, whereby, upon separation of said one leg from said head portion, said attractant material provides a prize to a holder of said one leg.

5. An amusement device comprising:

a. a wishbone shaped body having spaced, divergent hollow legs joined at a head portion;

b. an attractant feature within said body and distinct therefrom and emplaced within at least one of said legs and comprising a prize, including a message, coupon, fragrance vial, device or other means of endearment for the recipient; and c. radial separation means facilitating separation of at least a portion of one leg from said head prtion, thereby exposing said attractant feature in said leg.

6. An amusement device comprising:

a. a wishbone shaped body having spaced divergent legs joined at a head portion;

b. an attractant feature within said body and emplaced within at least one of said legs and containing a prize, including a message, coupon, fragrance vial, device or other means of endearment for the recipient; and means in at least said one leg for selectively opening said leg and exposing said feature to view.

* * * * *